US007160346B2

(12) United States Patent
Park

(10) Patent No.: US 7,160,346 B2
(45) Date of Patent: Jan. 9, 2007

(54) DUST AND DIRT COLLECTING UNIT FOR VACUUM CLEANER

(75) Inventor: Chang-Do Park, Changwon (KR)

(73) Assignee: LG Electronics, Inc., Seoul (KR)

( * ) Notice: Subject to any disclaimer, the term of this patent is extended or adjusted under 35 U.S.C. 154(b) by 488 days.

(21) Appl. No.: 10/390,894

(22) Filed: Mar. 19, 2003

(65) Prior Publication Data

US 2004/0093684 A1 May 20, 2004

(30) Foreign Application Priority Data

Nov. 15, 2002 (KR) ..... 10-2002-0071332

(51) Int. Cl.
*B01D 50/00* (2006.01)

(52) U.S. Cl. ..... 55/337; 55/426; 55/429; 55/459.1; 55/505; 55/DIG. 3

(58) Field of Classification Search ..... 55/337, 55/429, 426, 459.1, 505, 508, DIG. 3; 15/352, 15/353
See application file for complete search history.

(56) References Cited

U.S. PATENT DOCUMENTS

| | | | | |
|---|---|---|---|---|
| 5,259,854 | A * | 11/1993 | Newman | 55/320 |
| 6,269,518 | B1 * | 8/2001 | Yung | 15/352 |
| 6,461,508 | B1 * | 10/2002 | Thomson | 210/512.1 |
| 6,613,116 | B1 * | 9/2003 | Oh | 55/413 |
| 6,616,721 | B1 * | 9/2003 | Oh | 55/426 |

FOREIGN PATENT DOCUMENTS

| | | |
|---|---|---|
| JP | 64-40459 | 3/1989 |
| JP | P2002-65532 A | 3/2002 |
| KR | 1020040032013 | 4/2004 |

* cited by examiner

*Primary Examiner*—Robert A. Hopkins
(74) *Attorney, Agent, or Firm*—Fleshner & Kim, LLP

(57) ABSTRACT

The present invention relates to a dust and dirt collecting unit for a vacuum cleaner capable of simultaneously performing a primary cyclonic dust collection and a secondary filter dust collection. According to the present invention, there is provided a dust and dirt collecting unit for a vacuum cleaner, which is mounted to one side of a main body of the vacuum cleaner to filter sucked air containing foreign substances. The dust and dirt collecting unit of the present invention comprises a dust casing which has an inlet formed in a direction tangential thereto for introducing the air containing the foreign substances thereinto and of which a top portion is open; a cover which is used to open and close the top portion of the dust casing and is provided at the center thereof with an outlet for discharging air from which the foreign substances have been filtered out; a filter assembly which is installed at a bottom surface of the cover corresponding to the outlet and includes a cylindrical filter of which the interior communicates with the outlet; a protective cylindrical body which is formed to wrap around an outer periphery of the filter assembly and installed below the cover so that the interior thereof can communicate with the exterior thereof through a plurality of vent holes formed at a lower portion thereof; and a separating plate which is coupled with the bottom of the filter assembly and extends radially to be spaced apart from an inner circumferential surface of the dust casing by a predetermined gap.

19 Claims, 4 Drawing Sheets

DUST AND DIRT COLLECTING UNIT FOR VACUUM CLEANER

BACKGROUND OF THE INVENTION

1. Field of the Invention

The present invention relates to a dust and dirt collecting unit for a vacuum cleaner, and more particularly, to a dust and dirt collecting unit for a vacuum cleaner wherein a filter in the cyclonic dust and dirt collecting unit can be protected from impact by foreign substances and its interior constitution can be more simplified.

2. Description of the Prior Art

A vacuum cleaner is an apparatus for sucking air containing foreign substances by means of vacuum pressure, which is generated by a vacuum motor installed within a main body of the vacuum cleaner, and then filtering out the foreign substances from the air in the main body thereof. Further, a paper filter taking the shape of an envelope has been generally used as a filter for filtering out the foreign substances to be sucked. Such a paper filter can filter out the foreign substances such as dust and dirt contained in the sucked air, because the paper filter is designed to allow the air to penetrate therethrough but the foreign substances to remain therein.

However, the vacuum cleaner with the paper filter used therein has inconvenience in use in that if the foreign substances are accumulated within the paper filter to a predetermined level after a certain period of use, suction power of the vacuum cleaner is reduced and thus the paper filter must be periodically replaced with a new one.

In order to solve the inconvenience, a vacuum cleaner in which the filtering action is performed in a cyclonic fashion has been proposed. FIG. 1 shows a conventional cyclonic vacuum cleaner.

As shown in the figure, the vacuum cleaner comprises a main body 20 in which a suction means for sucking the air in the room is installed, a connection hose 34 which is made of a flexible material and connected to communicate with the interior of the main body 20, a variable length extension tube 32 installed to communicate with an end of the connection tube 34, and a suction nozzle 31 for sucking the air containing foreign substances from a floor by means of suction power generated from the main body 20.

Further, a dust and dirt collecting unit 21 that is detachably mounted is installed in the rear of the main body 20. The dust and dirt collecting unit 21 is formed with a handle 21*a* for allowing a user to grasp the dust and dirt collecting unit when mounting or demounting the unit to or from the rear of the main body 20 of the vacuum cleaner. The dust and dirt collecting unit 21 is a part for causing the air containing the foreign substances sucked from the suction nozzle 31 to be introduced thereinto and then performing the filtering of the foreign substances. At a side of the main body 20 is formed a discharge portion 29 for discharging the air, from which the foreign substances are filtered out in the dust and dirt collecting unit 21, to the atmosphere.

A pair of wheels 28 for causing the main body 20 to travel on the floor are rotatably installed on the bottom of the main body 20. Further, a power cord 26 through which the vacuum cleaner is supplied with electric power is installed at the other side of the main body 20. The power cord 26 is installed such that it can be wound around a cord reel (not shown) in the main body and be received in the main body. A handle 24, which the user can grip when intending to carry the vacuum cleaner, is also installed at a top surface of the main body 20.

When the vacuum cleaner constructed as such is operated, the suction power is transmitted to the suction nozzle 31 through the connection hose 34 and the extension tube 32 by means of the vacuum pressure generated in the main body. Here, the suction power can be adjusted by a switch 33*a* that is installed on a grip portion 33 coupled with an upper portion of the extension tube 32.

The air containing the foreign substances on the floor to be cleaned is introduced into the main body 20, through the suction nozzle 31, the extension tube 32 and the connection hose 34, by means of the suction power. Then, the air is introduced into the dust and dirt collecting unit 21. Next, the conventional dust and dirt collecting unit 21 will be discussed with reference to FIG. 2.

The conventional dust and dirt collecting unit 21 includes a dust casing 23 of which a top portion is open and which takes the shape of a container, and a cover 22 capable of opening and closing the top portion of the dust casing 23. The dust casing 23 is provided with an inlet 23*a* through which the air containing the foreign substances sucked from the suction nozzle 31 is introduced. The inlet 23*a* is formed in a direction tangential to the dust and dirt collecting unit 21 so that the air introduced into the dust and dirt collecting unit 21 can flow in the form of spiral airflow within the dust and dirt collecting unit.

A pair of semicircular separating plates 23*b*, 23*c* are installed at a lower portion of the interior of the dust casing 23. The separating plates 23*b*, 23*c* can be supported within the dust casing 23, by causing central shafts 23*d*, 23*e* of the separating plates to be pivotally mounted onto an inner circumferential surface of the dust casing 23. Further, the separating plates 23*b*, 23*c* are supported in a horizontal state and also installed such that they can pivot on the central shafts 23*d*, 23*e* only upwardly from the shown horizontal state. For example, the separating plates 23*b*, 23*c* may be horizontally supported by means of supporting projections (not shown) formed on the inner circumferential surface of the dust casing 23.

Thus, the separating plates 23*b*, 23*c* can pivot only upwardly from the horizontally supported state by means of the supporting projections that protrude from the inner circumferential surface of the dust casing 23.

A dust and dirt collecting space for collecting the foreign substances therein is defined at the lower portion of the interior of the dust casing 23 by the separating plates 23*b*, 23*c*. Further, a communicating passage 23*f* through which the foreign substances can fall down into the dust and dirt collecting space is formed at one side of the separating plate 23*b*.

Furthermore, an outlet 22*a* is formed in the center of the cover 22. The outlet 22*a* is a part which is formed such that the air from which the foreign substances have been filtered out in the dust casing 23 can be discharged through the discharge portion 29.

A cylindrical filter 25 is installed below the outlet 22*a*. The filter 25 is also detachably mounted to a bottom surface of the cover 22 so that the cylindrical interior thereof can be in communication with the outlet 22*a*.

Next, the operation of the conventional vacuum cleaner and the dust and dirt collecting unit 21 constructed as such will be discussed. If a motor placed in the main body 20 of the vacuum cleaner is operated and the suction power is then generated, the air containing the foreign substances is introduced through the suction nozzle 31. The air is introduced into the main body 20 via the extension tube 32 and the connection hose 34, and then guided into the inlet 23*a* of the dust casing 23 described above.

The air stream introduced into the dust casing 23 through the inlet 23*a* becomes the spiral airflow that flows along the cylindrical inner circumferential surface of the dust casing 23. While the spiral airflow is created as such, the relatively heavy foreign substances fall down into the lower portion of the dust casing 23. Then, these foreign substances fall down onto a floor surface of the dust casing 23 through the communicating passage 23*f* of the separating plate 23*b*.

The air from which the relatively heavy foreign substances are filtered out in the cyclonic fashion passes through the filter 25 installed in the center of the dust casing 23 from the outside to the inside of the filter 25. While the air passes into the filter 25, the fine foreign substances contained in the air are sufficiently filtered out.

The air guided into the cylindrical filter 25 is discharged through the outlet 22*a* formed on a top surface of the cover 22. The air discharged through the outlet is used to cool the motor in the main body 20 while passing by the motor. Then, the air is completely discharged from the main body 20 through the discharge portion 29.

As the vacuum cleaner is operated according to such a process, the foreign substances are accumulated in the dust casing 23. That is, the foreign substances filtered out in the cyclonic dust-collecting manner are accumulated below the separating plates 23*b*, 23*c* in the dust casing 23. Furthermore, if the amount of the accumulated foreign substances is greater than a predetermined level, the foreign substances must be emptied from the dust casing 23.

To this end, the dust and dirt collecting unit 21 will be separated or demounted from the main body 20. Then, the cover 22 is also separated from the separated dust and dirt collecting unit 21. If the cover 22 is separated, the filter 25 mounted to the bottom surface of the cover can also be separated. Thus, the separated filter 25 may be cleaned or washed, if necessary.

In addition, if the user causes the dust casing 23 to be inverted so as to empty the foreign substances from the dust casing 23, the separating plates 23*b*, 23*c* will pivot downward on the supporting shafts 23*d*, 23*e*, respectively. Thus, the foreign substances, which have been accumulated below the separating plates in the dust casing before the dust casing is inverted, can be completely emptied.

However, the conventional vacuum cleaner and the dust and dirt collecting unit constructed as such have the following problems.

First, the foreign substances are also contained in the air introduced through the inlet 23*a* as described above. Herein, the foreign substances contained in the air to be introduced through the inlet 23*a* have a velocity corresponding to the suction power and may collide against a surface of the filter. If the foreign substances, particularly large and heavy foreign substances, which collide against the surface of the filter as such, come into contact with the surface of the filter, the filter itself may be damaged. Thus, there is a problem in that suction performance or filtering efficiency of the vacuum cleaner may be deteriorated.

Further, it can be easily understood that the separating plates 23*b*, 23*c* are further installed within the dust casing 23 so as to perform the dust and dirt collection in the cyclonic fashion. That is, the dust and dirt collecting unit is constructed such that the dust collecting space for accumulating the foreign substances therein is defined at the lower portion of the dust casing 23 by means of the separating plates 23*b*, 23*c* which are separately manufactured and then mounted in the dust casing 23.

Therefore, since the pair of separating plates 23*b*, 23*c* manufactured separately are installed in the dust casing 23, the number of parts will be substantially increased, and consequently, the manufacturing process becomes complicated. That is, it can be easily understood that the problems such as increase of production costs and limitations on the productivity in the manufacturing process occur due to the increase of the number of parts.

SUMMARY OF THE INVENTION

The present invention is conceived to solve the above problems in the prior art. A primary object of the present invention is to provide a more simple dust and dirt collecting unit for use in a cyclonic vacuum cleaner.

Another object of the present invention is to provide a structure capable of protecting the filter installed within the dust and dirt collecting unit having a cyclonic dust collecting function from impact by foreign substances, and particularly, preventing mesh clogging of the filter.

According to an aspect of the present invention for achieving the object, there is provided a dust and dirt collecting unit for a vacuum cleaner, which is mounted to one side of a main body of the vacuum cleaner to filter sucked air containing foreign substances. The dust and dirt collecting unit comprises a dust casing which has an inlet formed in a direction tangential thereto for introducing the air containing the foreign substances thereinto and of which a top portion is open; a cover for opening and closing the top portion of the dust casing, said cover being provided at the center thereof with an outlet for discharging air from which the foreign substances have been filtered out; a filter assembly installed at a bottom surface of the cover corresponding to the outlet, said filter assembly including a cylindrical filter of which the interior communicates with the outlet; a protective cylindrical body which is cylindrically formed to wrap around an outer periphery of the filter assembly and installed below the cover so that the interior thereof can communicate with the exterior thereof through a plurality of vent holes formed at a lower portion thereof; and a separating plate which is coupled with the bottom of the filter assembly and extends radially to be spaced apart from an inner circumferential surface of the dust casing by a predetermined gap.

According to another aspect of the present invention, there is provided a dust and dirt collecting unit for a vacuum cleaner, which is mounted to one side of a main body of the vacuum cleaner to filter sucked air containing foreign substances. The dust and dirt collecting unit comprises a dust casing which has an inlet formed in a direction tangential thereto for introducing the air containing the foreign substances thereinto and of which a top portion is open; a cover for opening and closing the top portion of the dust casing, said cover being provided at the center thereof with an outlet for discharging air from which the foreign substances have been filtered out; a filter assembly installed at a bottom surface of the cover corresponding to the outlet, said filter assembly including a cylindrical filter of which the interior communicates with the outlet; a protective cylindrical body which is formed to wrap around an outer periphery of the filter assembly and installed below the cover so that the interior thereof can communicate with the exterior thereof through a plurality of vent holes formed at a lower portion thereof, a separating plate which is coupled with the bottom of the filter assembly and extends radially to come into close contact with an inner circumferential surface of the dust casing; and a communicating passage which is cut out inwardly and concavely in at least a portion of the separating plate for communicating with a space defined between the separating plate and the dust casing.

Preferably, the separating plate is detachably mounted to the protective cylindrical body.

Further, it is preferred that the filter assembly include a radially extending upper flange portion which comes into close contact with the bottom surface of the cover, and a body which extends downward from the upper flange portion and forms a cylindrical framework of the frame for allowing the air to pass therethrough.

More preferably, the filter is cylindrically shaped to have a predetermined mesh and installed at an outer face of the body so that the foreign substances can be filtered out.

In addition, it is preferred that a plurality of coupling grooves be formed at an upper end of the protective cylindrical body and a plurality of radially extending coupling projections be formed at an upper end of the filter assembly to be fitted into the coupling grooves, respectively, so that the filter assembly is simultaneously supported onto the cover by causing the protective cylindrical body to be detachably mounted to the cover.

More preferably, the protective cylindrical body is mounted to the bottom surface of the cover by causing peripheral projections of the protective cylindrical body formed on the upper end thereof at a predetermined interval to be coupled with a plurality of arcuate hooks formed on the bottom surface of the cover at the predetermined interval.

Furthermore, it is preferred that a top surface of the separating plate be formed to be inclined downwardly and outwardly.

Moreover, it is preferred that the separating plate be detachably coupled with the protective cylindrical body by causing coupling projections formed at the center of the bottom of the protective cylindrical body to be threading engaged with coupling holes formed at the center of the separating plate.

It is also preferred that a stop plate, which extends radially and protrudes upwardly, be formed on a floor surface of the dust casing.

Preferably, the vent holes are formed at a side of the protective cylindrical body located below the inlet of the dust casing through which the air is sucked.

More preferably, mesh nets are installed at the vent holes so as to filter out the foreign substances. Further, it is preferred that each of the mesh nets be sized to have a relatively larger mesh than that of the filter.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, preferred embodiments of the present invention will be described in detail with reference to the accompanying drawings.

Figure 1:
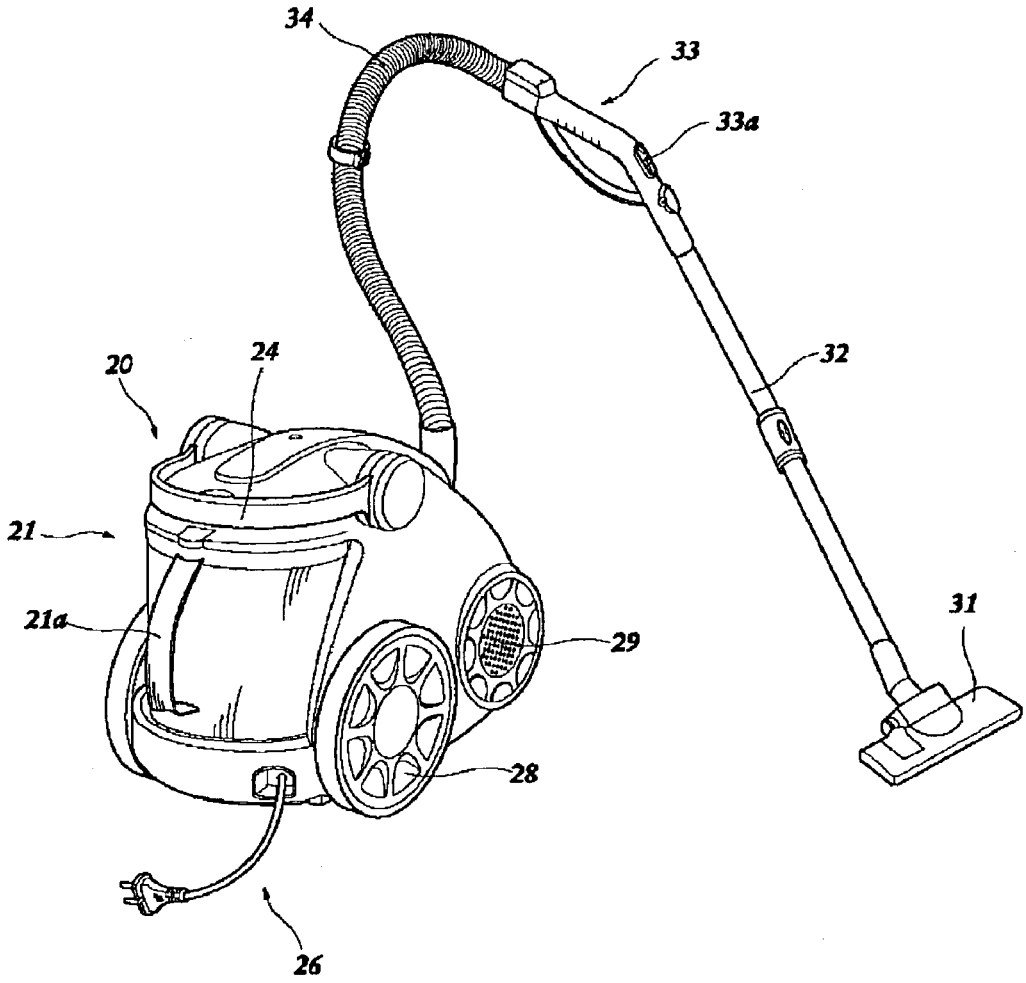
FIG 1. (PRIOR ART)
FIG. 1 is a perspective view of a conventional vacuum cleaner.
Figure 2:
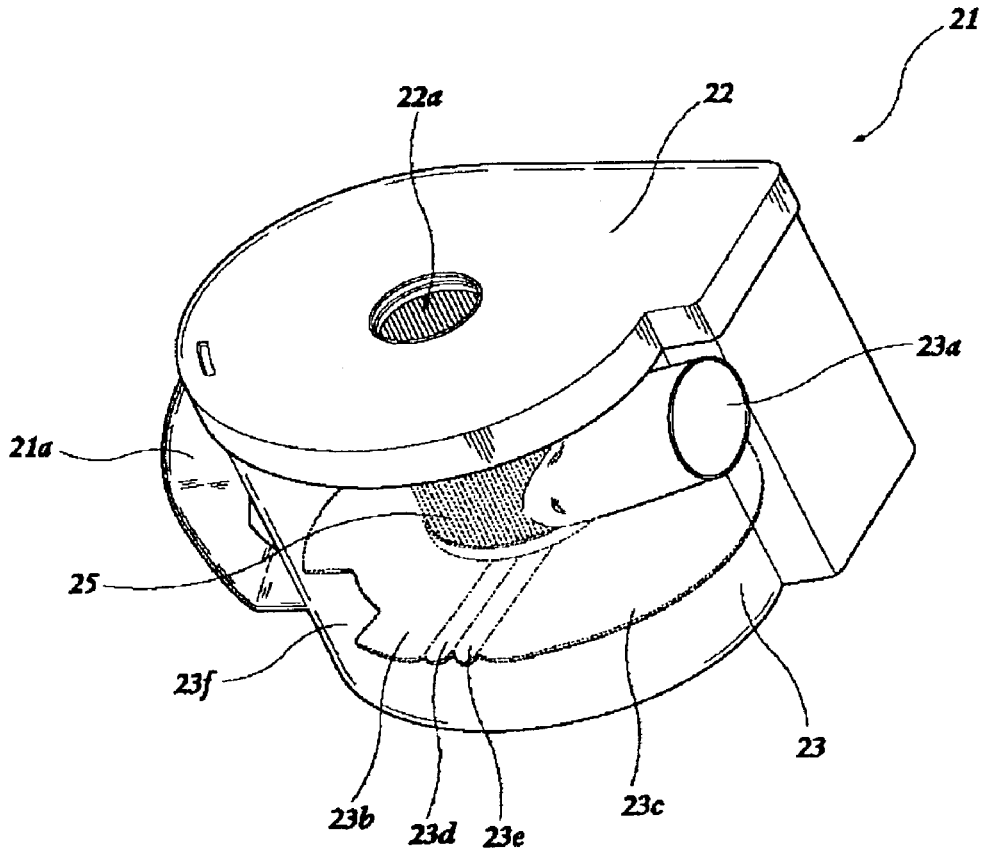
FIG 2. (PRIOR ART)
FIG. 2 is a perspective view of a conventional dust and dirt collecting unit.
Figure 3:
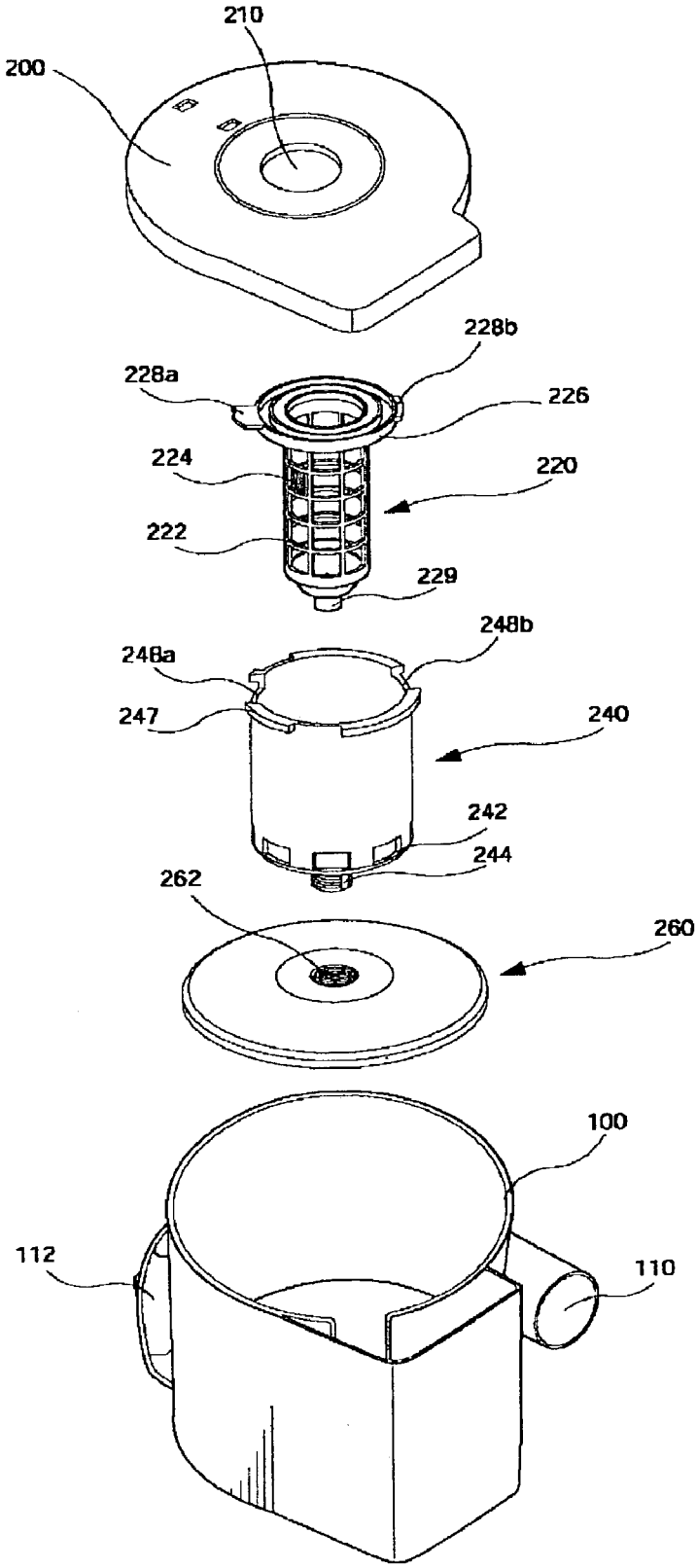
FIG. 3 is an exploded perspective view of a dust and dirt collecting unit according to the present invention.
Figure 4:
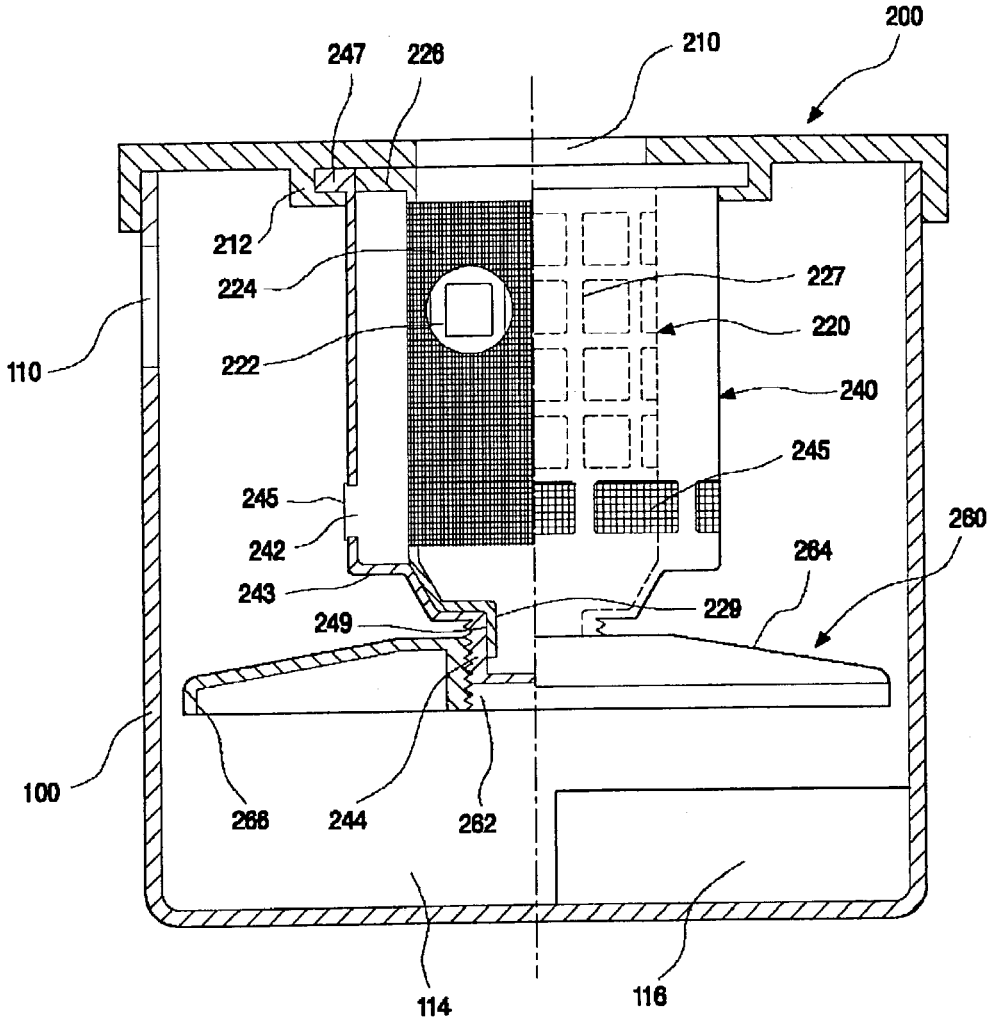
FIG. 4 is a sectional view of the dust and dirt collecting unit according to the present invention.

FIG. 3 is an exploded perspective view of a dust and dirt collecting unit according to the present invention, and FIG. 4 is a sectional front view of the dust and dirt collecting unit according to the present invention. As shown in these figures, the dust and dirt collecting unit of the present invention comprises a dust casing 100 of which a top portion is open, and a cover 200 which is detachably mounted to the open top portion of the dust casing 100.

The dust casing 100 is formed to take the shape of a hollow cylinder of which a top end is open. A handle 112, which a user grasps when intending to mount or demount the dust casing 100 into or from a rear portion of a main body of the vacuum cleaner, is formed at a rear portion of the dust casing 100.

The dust casing 100 includes an inlet 110 through which air containing foreign substances is sucked. Since the inlet 110 is formed at an upper portion of the dust casing 100 in a direction tangential to an outer periphery of the dust casing to communicate with the dust casing 100, an air stream sucked into the dust casing 100 through the inlet 110 becomes spiral airflow starting from an upper portion of the interior of the dust casing 100.

The cover 200 is mounted to the open top portion of the dust casing 100 so that it can open and close the open top portion. A circular outlet 210 is formed in the center of the cover 200 so that air from which the foreign substances have been filtered out within the dust casing 100 can be discharged to the atmosphere.

A cylindrical filter assembly 220 is mounted to a bottom surface of the cover 200. The filter assembly 220 comprises a cylindrical frame 222 and a net-type cylindrical filter 224 installed on an outer periphery of the frame.

The frame 222 is made of a synthetic resin material through injection molding. The frame 222 comprises a radially extending upper flange portion 226 which is close contact with the bottom surface of the cover 200, and a body 227 which extends downward from the upper flange portion and forms a cylindrical framework of the frame for allowing the air to pass therethrough. That is, the body 227 for forming a central portion of the frame 222 is made in the shape of a lattice so as to allow the air to pass through the body. The filter 224 may be formed with a very fine mesh net and made of a fiber material, metallic material or the like. The filter 224 is to filter out the foreign substances contained in the air passing through the filter from the outside thereof.

Further, a protective cylindrical body 240 for protecting the filter 224 from the foreign substances introduced through the inlet 110 is installed at the outside of the filter assembly 220. The protective cylindrical body 240 is formed to wrap around the filter assembly 220 and to extend downward up to a lower end of the filter 224. An upper end of the protective cylindrical body 240 is detachably mounted to the bottom surface of the cover 200. In addition, the bottom of the protective cylindrical body 240 is hermetically closed.

A plurality of vent holes 242 are formed on the periphery of the protective cylindrical body 240 at a lower end thereof. The vent holes 242 are configured such that the air in the dust casing 100 can flow toward the filter assembly 220 through the holes. Further, it is preferred that the vent holes 224 be formed at positions lower than the inlet 110 of the dust casing 100.

Since the vent holes 242 are merely to allow the air in the dust casing 100 to be guided toward the filter assembly 220, they cannot be limited in view of the positions where the holes are formed. For example, a plurality of vent holes may be formed on the periphery of the protective cylindrical body 240 at the lower end thereof, as described above. Alternatively, it will be apparent that the plurality of vent holes can be formed at the bottom 243 of the protective cylindrical body 240.

Mesh nets 245 made of the fiber material, the metallic material or the like are attached to the vent holes 242, respectively. Each of the mesh nets 245 is to again filter out the foreign substances contained in the air passing through the relevant vent hole 242. It is also preferred that each of the mesh nets 245 be configured to have a mesh relatively larger than that of the aforementioned filter 224.

An upper end of the protective cylindrical body 240 is detachably coupled to the bottom surface of the cover 200, for example, in such a manner that a plurality of peripheral projections 247, which extend radially from the upper end of the protective cylindrical body 240 to be spaced apart from one another in an angular direction, are coupled into a plurality of arcuate hooks 212 which are formed on the bottom surface of the cover 200 to be spaced apart from one another by a predetermined interval, respectively.

As shown in FIG. 3, a pair of coupling grooves 248*a*, 248*b* formed to be concave downward are formed at the upper end of the protective cylindrical body 240. Further, a pair of radially extending coupling pieces 228*a*, 228*b* are formed at the upper flange portion 226 of the filter assembly 220. When the filter assembly 220 is coupled with the protective cylindrical body 240, the pair of coupling pieces 228*a*, 228*b* are securely seated into the pair of coupling grooves 248*a*, 248*b*, respectively, in a state where the upper flange portion 226 comes into close contact with an inner circumferential surface of an open upper portion of the protective cylindrical body. Thus, the filter assembly 220 can be supported on the inside of the protective cylindrical body 240 in such a manner.

Then, since the peripheral projections 247 of the protective cylindrical body 240 are coupled into the arcuate hooks 212 formed on the bottom surface of the cover 200 in such a state, both the filter assembly 220 and the protective cylindrical body 240 can be substantially supported on the bottom surface of the cover 200.

As shown in the figures, since one coupling piece 228*a* extends outward farther than the other one 228*b*, the coupling piece 228*a* protrudes outward when the filter assembly 220 is coupled to the protective cylindrical body 240. Thus, it can be understood that the coupling piece 228*a* is used to allow a user to more easily grasp the coupling piece when intending to separate the filter assembly 220 from the protective cylindrical body 240.

However, the present invention may not be limited to this preferred embodiment. That is, it is sufficient in the present invention that the filter assembly 220 can be mounted on the bottom surface of the cover 200 and that the protective cylindrical body 240 can be also mounted on the bottom surface of the cover 200 while wrapping around the filter assembly 220.

In a state where they are coupled with one another as such, the interior of the filter assembly 220 is in communication with the outlet 210 formed at the center of the cover 200. Thus, the air, from which the foreign substances are filtered out while the air passes through the filter assembly 220 from the outside to the inside, can be discharged through the outlet 210 to the atmosphere.

In the illustrated embodiment of the present invention, the filter assembly 220 can be more firmly coupled to the protective cylindrical body 240 by causing the a lower end 229 of the frame 222 of the filter assembly 220 to be fitted into a retaining groove 249 formed on a floor surface of the protective cylindrical body 240.

A separating plate 260 is also attached to the bottom of the protective cylindrical body 240. The separating plate 260 is to perform a function of dividing the interior of the dust casing 100 into two spaces, so that a dust collecting space 114 can be defined below the plate 260. Further, the separating plate 260 is configured such that it extends radially further than the protective cylindrical body 240 but is slightly spaced apart from the inner circumferential surface of the dust casing 100.

In the illustrated preferred embodiment of the present invention, a coupling projection 244 with a threaded portion formed on an outer periphery thereof is formed to extend downward from the center of the bottom of the protective cylindrical body 240, and a coupling hole 262 with a threaded portion to be coupled with the threaded portion of the coupling projection 244 formed on an inner periphery thereof is formed at the center of the separating plate 260. Thus, the separating plate 260 is coupled to the protective cylindrical body 240 by causing the coupling projection 244 and the coupling hole 262 to be threadingly engaged with each other.

The foreign substances, which are contained in the air introduced through the inlet 110, will be able to fall down onto a floor surface of the dust casing 100 through a gap defined between the separating plate 260 and the inner circumferential surface of the dust casing 100.

A top surface 264 of the separating plate 260 is formed as a surface downwardly inclined in an outward radial direction. Thus, the foreign substances, which fall down onto the inclined surface 264 while the dust collection is performed in the cyclonic fashion, can be more smoothly guided downward along the inclined surface 264.

Further, a portion 266 extending substantially vertically and downwardly from the inclined surface 264 is formed at an outer edge of the inclined surface 264. That is, the separating plate 260 is formed to be concave as viewed from below. Thus, the foreign substances contained in the spiral airflow generated during the cyclonic dust-collecting process can be more efficiently prevented from being lifted again from below to above the separating plate 260.

In the preferred embodiment, the separating plate 260 is mounted to the bottom of the protective cylindrical body 240 by causing the coupling projection 244 and the coupling hole 262 to be threadingly engaged with each other. However, it is apparent that if the separating plate 260 can be mounted to the bottom of the protective cylindrical body 240, various modifications can be made thereto.

In addition, in the illustrated embodiment of the present invention, the separating plate 260 is spaced apart from the inner circumferential surface of the dust casing 100 by the predetermined gap. However, since the separating plate 260 is merely to define a dust collecting space 114 below the plate within the dust casing, it is sufficient it the separating plate 260 is configured to be capable of communicating with the dust collecting space 114. Alternatively, the separating plate 260 may be configured in such a manner that the plate 260 is almost brought into close contact with the inner circumferential surface of the dust casing 100 and a communication passage is formed on the outer edge of the separating plate 260 so that the foreign substances can fall down into the dust collecting space 114 through the communication passage.

Furthermore, a stop plate 116 is formed to protrude upwardly from the floor surface of the dust casing 100. The stop plate 116 is designed to prevent the foreign substances fallen down onto the floor surface of the dust casing 100 from being continuously swirling within the dust casing due to the swirl airflow that has been generated by the air swirling within the dust casing 100 when the dust collection is made in the cyclonic fashion. That is, although the foreign substances temporarily swirl together with the air due to the spiral airflow generated in the dust casing, the foreign substances are caused to stop further swirling in the dust casing and are collected near the stop plate 116 when they collide against the stop plate. Moreover, the stop plate 116 allows the foreign substances to be kept in a stationary state and not to be lifted again from the floor surface of the dust casing 100 by the spiral airflow generated in the casing.

Next, the overall operation of the dust and dirt collecting unit of the present invention will be explained with reference to FIGS. 3 and 4.

When the vacuum cleaner is operated, a suction nozzle causes the air containing the foreign substances to be sucked by means of the suction power generated in the main body of the vacuum cleaner while traveling on the floor to be cleaned. The air containing the foreign substances is introduced into the dust casing 100 through the inlet 110 thereof.

The air introduced into the dust casing 100 of which the top portion is closed by the cover 200 becomes the spiral airflow because the inlet 110 is formed tangentially at the dust casing 100.

The relatively heavy foreign substances included in the spiral airflow fall down due to their own weights. The foreign substances fall down onto the floor surface of the dust casing 100 through the gap defined between the separating plate 260 and the inner circumferential surface of the dust casing 100. Some portions of the foreign substances fall down directly through the gap, whereas the other portions of them are guided along the inclined surface 264 of the separating plate 260 and then downward into the dust collecting space 114 through the gap defined between the separating plate 260 and the inner circumferential surface of the dust casing 100.

Further, the foreign substances contained in the air introduced into the inlet 110 can be prevented from colliding directly against the filter 224 by means of the protective cylindrical body. Thus, the filter 224 can be sufficiently prevented from being damaged due to the collision of the foreign substances.

In such a manner, the foreign substances contained in the sucked air are primarily filtered out in accordance with the aforementioned cyclonic duct-collecting fashion. It is apparent that the relatively large foreign substances are filtered out during the process of the cyclonic dust collection.

Further, during the process of the cyclonic dust collection, the foreign substances accumulated on the floor surface of the dust casing 100 are not further swirled due to the stop plate 114 and are then collected near the stop plate.

As mentioned above, the cyclonic dust collection is primarily performed within the dust casing 100 so that the heavy foreign substances contained in the air can be accumulated onto the floor surface of the dust casing 100 while the air is swirling in the dust casing 100. After the primary dust collection has been completed, the air passes through the vent holes 242 and then guided to the filter 224 installed at the center of the dust casing 100.

Then, the foreign substances contained in the air are again filtered out by means of the mesh nets 245 installed at the vent holes 242. Further, while the air passed through the mesh nets 245 passes through the filter 224 again, the foreign substances are again filtered out from the air. Even fine foreign substances such as substantially very fine dusts are completely filtered out by the filter 224 having a finer mesh than the mesh nets 245.

The air passing through the filter 224 from the outside to the inside becomes clean air from which fine foreign substances have been completely filtered out by the filter 224. Further, since the interior of the filter 224 is in communication with the outlet 210 of the cover 200, the air is discharged through the outlet 210. The air discharged through the outlet 210 cools the motor, for example, installed within the main body of the vacuum cleaner, and then, is completely discharged to the outside of the vacuum cleaner.

As described above, it can be easily understood that the present invention is configured in such a manner that the protective cylindrical body 240 is installed around the filter assembly 220 mounted on the bottom surface of the cover 200 for opening and closing the open top portion of the dust casing 100 and the sucked air passes through the filter via the vent holes 242 of the protective cylindrical body. Further, it can also be understood that the separating plate 260 is installed to the bottom of the protective cylindrical body 240.

Next, a modified embodiment of the separating plate 260 according to the present invention will be discussed.

In the previous preferred embodiment, the predetermined gap is defined between the outer periphery of the separating plate 260 and the inner circumferential surface of the dust casing 100. That is, the separating plate 260 is sized such that the outer periphery thereof is spaced apart from the inner circumferential surface of the dust casing 100 by the predetermined gap.

However, the separating plate 260 of the present invention basically functions to define a specific dust collecting space so that the foreign substances, which fall down onto the floor surface of the dust casing 100 during the cyclonic dust-collecting process, can be collected in the dust casing 100. Thus, it is apparent that the separating plate 260, which is attached to the bottom of the filter assembly 220 to collect the foreign substances in the dust casing 100, may be modified in various manners.

For example, the separating plate 260 may be constructed such that the outer periphery thereof is brought into close contact with the inner circumferential surface of the dust casing 100. In such a case, in order to guide the foreign substances into the dust collecting space defined below the separating plate 260, the communicating passage through which the foreign substances can fall down into the dust collecting space should be formed by cutting out at least a portion of an outer periphery of the separating plate 260.

It is apparent that the foreign substances can be guided down into the separating plate 260 through the communicating passage even by bringing the separating plate 260 into close contact with the inner circumferential surface of the dust casing 100 and cutting out at least a portion of the outer periphery of the separating plate 260.

The present invention constructed as such has the following advantages:

First, the dust and dirt collecting unit of the present invention can smoothly perform the primary cyclonic dust collection and the second filter dust collection for filtering out the fine dust and dirt. Further, since dual filtering actions by the mesh nets 245 and the filter 224 are performed even during the filter dust collection, an efficiency of removing the foreign substances can be substantially maximized.

In addition, according to the present invention, since the filter assembly 220 is installed within the protective cylindrical body 220, the foreign substances introduced through the inlet of the dust casing can be prevented from directly coming into contact with the filter 224. Thus, since the filter 224 is sufficiently prevented from being damaged due to the impact of the introduced foreign substances against the filter, an advantage that the filter can be used to efficiently filter out the foreign substances for a long time is expected.

Furthermore, the separating plate 260 of the present invention can cause the foreign substances to be accumulated onto the floor surface of the dust casing in a remarkably simpler manner as compared with the conventional one, because the separating plate 260 is installed directly to the bottom of the protective cylindrical body 240.

Moreover, it will be apparent that production cost reduction and productivity improvement in the manufacturing process of the vacuum cleaner can be expected due to reduction in the number of parts, because the separating plate 260 and its organic connection to the other parts of the present invention can be implemented in a relatively simple manner.

Although the present invention has been described in connection with the preferred embodiments, it is not limited thereto. Obviously, it can be understood by the skilled in the art that various changes and modifications of the present invention can be made within the scope of the basic technical spirit of the present invention. The present invention should be construed based on the appended claims.

What is claimed is:

1. A dust and dirt collecting unit provided with a main body of the vacuum cleaner and configured to filter sucked air containing foreign substances, comprising:

a substantially cylindrical casing which has an open top portion and an inlet formed in a direction tangential to the casing which is configured to introduce air containing foreign substances into the casing;

a cover provided at the open top portion of the casing, said cover including an outlet for discharging air from which foreign substances have been filtered out;

a filter assembly provided at a bottom portion of the cover corresponding to the outlet, wherein the filter assembly includes a substantially cylindrical filter surrounding a substantially cylindrical lattice frame whose interior is in communication with the outlet, a radially extending upper flange portion which comes into close contact with the lower surface of the cover, and a body which extends downward from the upper flange portion to form the substantially cylindrical lattice frame which allows air to pass therethrough;

a substantially cylindrical protective body configured to surround an outer periphery of the filter assembly, wherein the protective body includes a plurality of vent holes formed at a lower portion thereof which are configured to maintain airflow communication between an interior and an exterior of the protective body; and a separating plate coupled to a bottom of the filter assembly and extending radially outward therefrom such that at least a portion of an outer peripheral surface of the separating plate is spaced apart from an inner circumferential surface of the dust casing by a predetermined gap.

2. The dust and dirt collecting unit as claimed in claim 1, wherein the substantially cylindrical filter has a predetermined mesh, and is configured to be installed at an outer face of the substantially cylindrical frame.

3. The dust and dirt collecting unit as claimed in claim 1, wherein a top surface of the separating plate is inclined downwardly in a radial direction, and wherein the separating plate is configured to direct foreign substances through the gap formed between the separating plate and the casing, and into a collecting space formed between a lower surface of the separating plate and a bottom inner surface of the casing.

4. The dust and dirt collecting unit as claimed in claim 1, wherein a coupling projection provided at a bottom portion of the protective body is configured to threadably engage a corresponding coupling hole formed in the separating plate so as to detachably couple the protective body and the separating plate, wherein the coupling projection is positioned at a bottom center portion of the protective body, and the corresponding coupling hole is formed at the center of the separating plate.

5. The dust and dirt collecting unit as claimed in claim 1, wherein the plurality of vent holes are formed in the protective body at a position below the inlet of the casing.

6. The dust and dirt collecting unit of claim 1, wherein the entire outer peripheral surface of the separating plate is spaced apart from the inner circumferential surface of the casing so as to form a predetermined gap surrounding the entire separating plate.

7. A vacuum cleaner comprising the dust and dirt collecting unit of claim 1.

8. A dust and dirt collecting unit provided with a main body of the vacuum cleaner and configured to filter sucked air containing foreign substances, comprising:

a substantially cylindrical casing which has an open top portion and an inlet formed in a direction tangential to the casing which is configured to introduce air containing foreign substances into the casing;

a cover provided at the open top portion of the casing, said cover including an outlet for discharging air from which foreign substances have been filtered out;

a filter assembly provided at a bottom portion of the cover corresponding to the outlet, wherein the filter assembly includes a substantially cylindrical filter surrounding a substantially cylindrical lattice frame whose interior is in communication with the outlet;

a substantially cylindrical protective body configured to surround an outer periphery of the filter assembly, wherein the protective body includes a plurality of vent holes formed at a lower portion thereof which are configured to maintain airflow communication between an interior and an exterior of the protective body, wherein a plurality of radially extending coupling projections formed at an upper end of the filter assembly are configured to be fitted into a corresponding plurality of coupling grooves formed at an upper end of the protective body so that the filter assembly is supported by the protective body and the protective body is detachably mounted to the cover; and a separating plate coupled to a bottom of the filter assembly and extending radially outward therefrom such that at least a portion of an outer peripheral surface of the separating plate is spaced apart from an inner circumferential surface of the dust casing by a predetermined gap.

9. The dust and dirt collecting unit as claimed in claim 8, wherein a plurality of peripheral projections formed at predetermined intervals on the upper end of the protective body are configured to be coupled with a corresponding plurality of arcuate hooks formed on the lower surface of the cover.

10. A dust and dirt collecting unit provided with a main body of the vacuum cleaner and configured to filter sucked air containing foreign substances, comprising:

a substantially cylindrical casing which has an open top portion and an inlet formed in a direction tangential to the casing which is configured to introduce air containing foreign substances into the casing;

a cover provided at the open top portion of the casing, said cover including an outlet for discharging air from which foreign substances have been filtered out;

a filter assembly provided at a bottom portion of the cover corresponding to the outlet, wherein the filter assembly includes a substantially cylindrical filter surrounding a substantially cylindrical lattice frame whose interior is in communication with the outlet;

a substantially cylindrical protective body configured to surround an outer periphery of the filter assembly, wherein the protective body includes a plurality of vent holes formed at a lower portion thereof which are configured to maintain airflow communication between an interior and an exterior of the protective body;

a plurality of mesh nets installed at the plurality of vent holes to filter out foreign substances; and a separating plate coupled to a bottom of the filter assembly and extending radially outward therefrom such that at least a portion of an outer peripheral surface of the separating plate is spaced apart from an inner circumferential surface of the dust casing by a predetermined gap.

11. The dust and dirt collecting unit as claimed in claim 10, wherein a mesh of each of the plurality of mesh nets is larger mesh than a mesh of the filter.

12. A dust and dirt collecting unit provided with a main body of the vacuum cleaner and configured to filter sucked air containing foreign substances, comprising:

a substantially cylindrical casing which has an open top portion and an inlet formed in a direction tangential to the casing which is configured to introduce air containing foreign substances into the casing;

a cover provided at the open top portion of the casing, said cover including an outlet for discharging air from which foreign substances have been filtered out;

a filter assembly provided at a bottom portion of the cover corresponding to the outlet, wherein the filter assembly includes a substantially cylindrical filter surrounding a substantially cylindrical lattice frame whose interior is in communication with the outlet;

a substantially cylindrical protective body configured to surround an outer periphery of the filter assembly, wherein the protective body includes a plurality of vent holes formed at a lower portion thereof which are configured to maintain airflow communication between an interior and an exterior of the protective body; and a separating plate coupled to a bottom of the filter assembly and extending radially outward therefrom such that only a portion of the outer peripheral surface of the separating plate is spaced apart from the inner circumferential surface of the casing such that a gap formed therebetween comprises a cut out portion of the separating plate.

13. The dust and direct collecting unit of claim 12, wherein the cut out portion forms a passage into a collecting space formed between a lower surface of the separating plate and a bottom inner surface of the casing, and wherein the passage is configured to direct foreign substances into the collecting space.

14. A dust and dirt collecting unit for a vacuum cleaner, comprising:

a housing having an inlet;

a protective body coupled to an upper portion of the housing;

a filter assembly positioned within the protective body, wherein the protective body includes a plurality of vent holes provided at a bottom side portion of the protective body which provide for airflow communication between an interior and an exterior thereof; and a separating plate coupled to a bottom of the filter assembly and extending radially outward therefrom such that only a portion of an outer peripheral surface of the separating plate is spaced apart from an inner circumferential surface of the housing such that a gap formed therebetween comprises a cut out portion of the separating plate.

15. The dust and dirt collecting unit of claim 14, wherein the filter assembly comprises a substantially cylindrical filter surrounding a substantially cylindrical lattice frame whose interior is in airflow communication with an outlet of the housing.

16. The dust and dirt collecting unit of claim 14, wherein a top surface of the separating plate is inclined downwardly in a radial direction so as to direct foreign substances through the gap and into the collecting space.

17. The dust and dirt collecting unit of claim 16, further comprising a stop plate provided in the collecting space which is configured to inhibit a spiral flow of air and foreign substances collected within the collecting space.

18. The dust and dirt collecting unit of claim 14, wherein the cut out portion forms a passage into a collecting space formed between a lower surface of the separating plate and a bottom inner surface of the housing, and wherein the passage is configured to direct foreign substances into the collecting space.

19. A dust and dirt collecting unit for a vacuum cleaner, comprising:

a housing having an inlet;

a protective body coupled to an upper portion of the housing;

a filter assembly positioned within the protective body, wherein the protective body includes a plurality of vent holes provided at a bottom side portion of the protective body which provide for airflow communication between an interior and an exterior thereof and a plurality of mesh nets positioned at the plurality of vent holes, wherein a mesh of each of the plurality of mesh nets is larger than a mesh of the filter.

* * * * *